US005894770A

United States Patent [19]

Rudkin, Jr. et al.

[11] Patent Number: 5,894,770

[45] Date of Patent: Apr. 20, 1999

[54] BARRELS FOR FIREARMS AND METHODS OF MANUFACTURING THE SAME

[76] Inventors: Henry A. Rudkin, Jr., Chalet No. 86A Certes, Sant Julia, Andorra; Donald Barker, 707 12th St., Cody, Wyo. 82414

[21] Appl. No.: 08/853,802

[22] Filed: May 9, 1997

Related U.S. Application Data

[62] Division of application No. 08/723,361, Sep. 30, 1996, Pat. No. 5,765,303.

[51] Int. Cl.[6] ..... B23B 1/00

[52] U.S. Cl. ..... 82/1.11; 82/118; 82/131; 407/12; 407/113

[58] Field of Search ..... 82/1.11, 131, 118, 82/110, 57, 58, 70, 82, 83, 85, 89, 93, 101, 102; 407/113, 33, 53, 64, 62, 12

[56] References Cited

U.S. PATENT DOCUMENTS

| | | | |
|---|---|---|---|
| Re. 32,211 | 7/1986 | Jerue et al. | 82/118 X |
| 3,922,766 | 12/1975 | Malinchak | 407/113 X |
| 5,396,821 | 3/1995 | Okumura et al. | 82/118 X |
| 5,713,253 | 2/1998 | Date et al. | 82/131 X |
| 5,765,303 | 6/1998 | Rudkin, Jr. et al. | 42/78 |

FOREIGN PATENT DOCUMENTS

| | | | |
|---|---|---|---|
| 501950 | 4/1920 | France | 407/12 |
| 224697 | 3/1943 | Sweden | 407/12 |
| 552048 | 3/1943 | United Kingdom | 407/12 |

*Primary Examiner*—Andrea L. Pitts
*Assistant Examiner*—Henry W. H. Tsai
*Attorney, Agent, or Firm*—Mark P. Stone

[57] ABSTRACT

Rifling for the barrel of a firearm includes a first gain twist region for increasing the rotational velocity of a bullet as it travels from the breech towards the muzzle end of the barrel, and a second region in which the rifling is of a constant twist so that the bullet exits the muzzle end of the barrel at a constant rotational velocity. The bore defined in the barrel is tapered in a direction from the breech end to the muzzle end so that the diameter of the muzzle opening of the barrel is less than the diameter of the breech opening. The angle of the rifling is variable with the rate of the gain twist of the rifling. The gain twist of the rifling in the barrel is formed by a button, preferably having a sinusoidal shaped periphery, which is pulled through the barrel during the manufacturing process. The smooth periphery of the button prevents shredding of the barrel when the button is twisted at different speeds to provide the variable gain twist of the rifling in different sections of the barrel. In a further aspect of the invention, an apparatus is provided for selectively varying the rotational speed of the button to form the desired gain twist of the rifling during manufacture of the barrel.

11 Claims, 6 Drawing Sheets

BARRELS FOR FIREARMS AND METHODS OF MANUFACTURING THE SAME

This application is division of application Ser. No. 08/723,361, filed Sep. 30, 1996, now U. S. Pat. No. 5,765, 303 pending.

BACKGROUND OF THE INVENTION

The present invention is directed to improved barrels for firearms and methods of manufacturing the same. In particular, the present invention provides improvements to: gain twists in the rifling of barrels of firearms; the design of a bore in the barrel such that the opening in the muzzle end is of a different diameter than the opening in the breech end (preferably the opening at the muzzle end is of a lesser diameter than the opening in the breech end of the bore of the barrel); varying the angle of the rifling defined in the bore of the barrel; providing a design for a button for forming the gain twist or varying the gain twist by selectively adjusting the rotational speed of the button as it is moved relative to the barrel without shredding the inner surface of the barrel during the manufacture process (preferably the button is designed with a sinusoidal shape periphery); and providing an apparatus for forming the desired gain twist and selectively varying the gain twist at different sections of the barrel during fabrication of the rifling.

Gain twists are provided in barrels of firearms for accelerating the rotational speed of a bullet as it travels from the breech end of the barrel towards the muzzle end of the barrel. Gain twists in the rifling of known firearms progressively increase the rate of twist of the rifling in a direction from the breech end towards the muzzle end of the bore of the barrel so that a bullet travelling through the bore is continuously rotationally accelerated until it is discharged from the opening in the muzzle end. However, constant acceleration of the rotational velocity of the bullet through the entire length of the barrel may diminish both the stability and accuracy of the discharged bullet as it exits the muzzle opening, and thus adversely affect the accuracy of the bullet after it is discharged from the firearm. Bullet performance may also be affected by the respective sizes of the openings in the breech and muzzle ends of the bore of the barrel, by the rate of twist of the rifling in the bore of the barrel, and by the peak pressure in the bore during discharge of the firearm.

Known methods of manufacturing rifling for barrels having a variable gain twist do not employ buttons pulled through the barrel at a variable rates of rotational speed because known button designs will shred the barrel during change in rotational speed. Accordingly, variable gain twists in rifling are currently formed by a cutter or scraper which is a laborious and expensive process. No satisfactory apparatus for manufacture of a barrel having a variable gain twist using the button method of fabrication is currently available.

It is the primary object of the present invention to provide an improved barrel for firearms for enhancing the performance of bullets discharged therefrom. In particular, the objects of the present invention include fabrication of a barrel for firearms having rifling of a variable gain twist and of a fixed twist at selected sections of the barrel; fabrication of a barrel for firearm having relative variable sized openings in the breech and muzzle ends of the barrel; and fabrication of a barrel for a firearm in which the rifling is selectively formed at variable angles relative to the inner surface of the barrel.

Further objects of the present invention include providing an improved button by which a variable gain twist in the rifling is fabricated by moving a button relative to the barrel while simultaneously rotating the button relative to the barrel, the barrel relative to the button, or both, at a variable rotational speed, and providing an apparatus (preferably controlled by a computer) for fabricating rifling in the barrel at a variable gain twist by selectively adjusting the relative rotational speed of the button or barrel as the button is moved relative to different sections of the barrel. It is further within the scope of the invention to fabricate a variable gain twist by electrolysis and acid etching procedures.

Other objects, improvements and advantages of the present invention will become apparent to those skilled in the art from the following discussion.

SUMMARY OF THE INVENTION

The present invention is directed to improvements to barrels for firearms and methods for manufacturing the same. In a first aspect of the present invention, a variable gain twist in the rifling of a barrel for a firearm if provided by progressively adjusting the rate of twist of the rifling at different sections within the barrel. A section of the barrel defined between the breech end is provided with rifling having a predetermined gain twist by which the rifling is spaced successively closer to adjacent rifling to accelerate the rotation of a bullet travelling through that section of the barrel. A second section of the barrel is defined between the end of the first section and the muzzle end of the barrel. The rifling in the second section is of a fixed twist and is equidistantly spaced so that a bullet travelling through the second section of the barrel is not rotationally accelerated and is discharged from the muzzle opening at a constant rotational velocity. Accordingly, the bullet is initially accelerated to a predetermined rotational velocity as it travels through the first section of the barrel, and is thereafter maintained at that maximum rotational velocity until it is discharged from the muzzle end. Discharge of the bullet from the firearm at a constant rotational velocity improves the performance of the bullet by enhancing the stability and accuracy thereof.

In a further aspect of the present invention, the bore in the barrel of a firearm is manufactured so that the opening in the breech end of the barrel is of a different diameter than the opening in the muzzle end of the barrel. A smaller diameter opening in the muzzle end improves performance of the discharge bullet by providing better accuracy and reduction of peak pressure within the barrel during discharge of the firearm. Reduction of peak pressure also increases the useful operating life of the barrel.

In a still further aspect of the invention, the angle of the rifling in the bore of the barrel is varied to enhance the performance of a bullet discharged from the firearm. The variation in the angle of the rifling relative to the inner surface of the barrel corresponds to the variation in the gain twist of the rifling in the barrel, e.i.—the greater the gain twist of the rifling, the greater is the relative angle of the rifling relative to the barrel.

In a further aspect of the invention, the variable gain twist of the rifling in the barrel of the firearm is fabricated by a process in which a button is moved relative to the barrel, and simultaneously the button and/or barrel are relatively rotated at different selected rotational speeds to adjust and progressively vary the rate of twist of the rifling in different areas of the barrel as the rotating button is advanced through different locations of the barrel. In this manner, the gain twist may be selectively increased and decreased at preselected locations along the barrel to adjust the rate of rotational acceleration of a bullet passing through the barrel during discharge of the firearm. In accordance with a preferred embodiment of the invention, the rate of twist is continuously and progressively increased in a section of the barrel from the breech end thereof to a predetermined distance behind the muzzle end to result in rotational acceleration of the bullet passing through that first section of the barrel, and a uniform or constant twist is provided in the rifling between the forward end of the first section and the muzzle end of the barrel so that a bullet travelling through the latter section of the barrel exits the muzzle opening at a constant rotational velocity.

The rifling is formed from a button which is configured to permit selective adjustment to the rotational speed thereof as the rotating button is moved relative to the barrel to provide the desired increase in the rate of twist at selected sections of the barrel during the manufacturing process. Preferably, the button is of a configuration having a smooth periphery (e.g., a sinusoidal shaped outer surface, and/or a button having grooves not including any parallel walls) to prevent shredding of the barrel as the rotational speed of the button is varied as the button is advanced relative to the barrel during the fabrication process.

In a further aspect of the present invention, the variable gain twist of the rifling of a barrel is fabricated by selectively adjusting the relative rotational speed of the button and the barrel as the button passes through the barrel, as discussed above, by an apparatus, preferably controlled by computer, for automatically adjusting the rotational speed of the button at preselected regions of the barrel. The control can be programmed in advance to fabricate different rate of twist at different sections of the barrel by adjusting the rotational speed of the button at different positions thereof relative to the barrel.

In still further aspects of the invention, a variable gain twist is provided in the barrel of a firearm by electrolysis and acid etching procedures.

Further improvements and features within the scope of the present invention will be apparent to those skilled in the art from the following detailed description in conjunction with the drawings.

BRIEF DESCRIPTION OF THE DRAWINGS

FIG. 4B schematically illustrates a rotatable cam attached to the apparatus of

FIG. 4A by a chain; and

DESCRIPTION OF THE BEST MODES FOR CARRYING OUT THE INVENTION

Figure 1A:
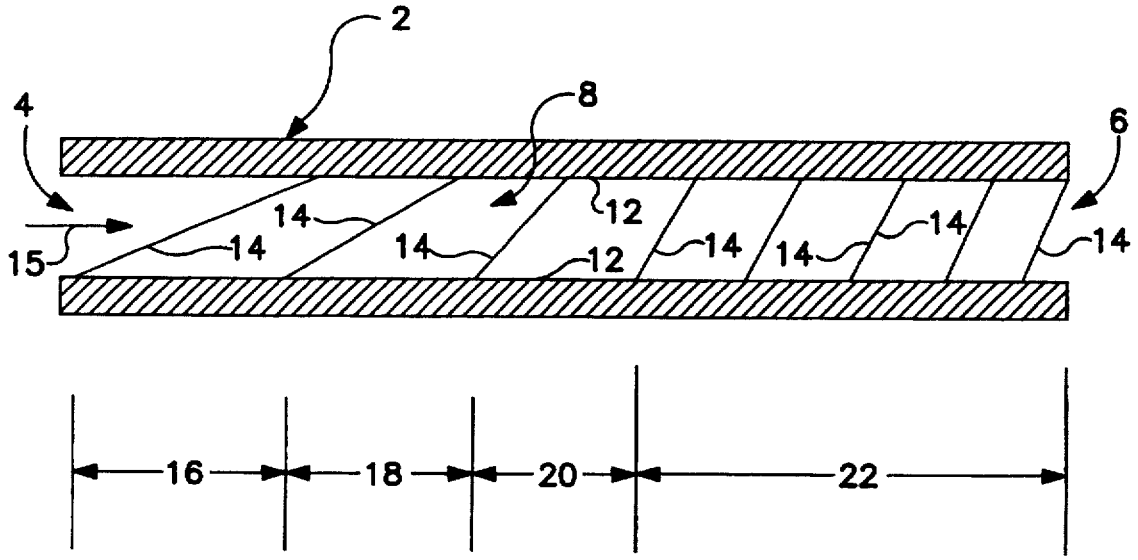
FIG. 1A of the drawing is a schematic view of rifling defined in the bore of the barrel of a firearm, in accordance with a first aspect of the present invention.

The present invention will now be discussed with reference to FIGS. 1–5 of the drawing.

Referring first to FIG. 1A, a barrel of a firearm is designated generally by reference numeral 2 and is illustrated schematically in section by the drawing. The breech end of the barrel is designated by reference numeral 4, and the muzzle end of the barrel is designated by reference numeral 6. A generally cylindrically configured bore 8 is defined within the barrel, and rifling (lands and grooves) defined on the inner surface 12 of the barrel is designated generally by reference numeral 14. A bullet 15 is shown proximate to the opening in the breech end of the barrel and pointing in a direction towards the muzzle opening.

Still referring to FIG. 1A, the drawing further illustrates a variable gain twist in accordance with the present invention. The barrel 2 has been divided into different integrally merged adjacent zones represented by reference numerals 16, 18, 20 and 22. The bullet 15 entering the barrel at the breech end 4 travels through the bore and passes through the first zone 16. The leftmost end of the zone 16 defines the opening in breech end 4 of the barrel 2. The gain twist of the rifling in the first zone 16 is, for illustrative purposes, designated as an average of one turn per 30 inches which represents the average rate of twist of the rifling defined in the inner surface 12 of the barrel. As is known to the art, the gain twist of the rifling corresponds to the rotational speed of a bullet travelling through the barrel. The greater the gain twist (i.e., the greater the number of turns of rifling per inch), the greater is the rotational velocity of a bullet travelling through the barrel. As the bullet 15 advances through the first zone 16 of the barrel, it enters a second adjacent zone designated by reference numeral 18. Zone 18, for illustrative purposes, has a gain twist or twist ratio of rifling of an average of one turn in twenty inches, thereby representing an increase in the ratio or gain twist of grooves from that of the first zone 16. Accordingly, the rotational speed of a bullet passing through zone 16 increases as the bullet enters adjacent zone 18 and travels therethrough in a direction from the breech end 4 towards the muzzle end 6. As the bullet continues its passage through zone 18, it enters into adjacent zone 20, which has a gain twist that is greater than that of zone 18 (i.e., an average of one turn per ten inches). Accordingly, as the bullet travels from zone 18 into zone 20, it experiences a further increase in its rotational velocity as a result of the increased gain twist of rifling defined in the inner surface 12 of the barrel 2 in the third zone 20. It is emphasized that although the drawing shows separate zones of the barrel having different rates of twist, this is for illustrative purposes only. In actuality, the rate of twist of rifling in the barrel increases continuously and progressively in a direction from the breech end towards the muzzle end of the barrel, and is not defined in discrete steps or zones.

As the bullet 15 continues to travel towards the muzzle opening and passes through zone 20, it enters a fourth adjacent zone 22. However, the twist ratio of rifling in zone 22 corresponds to that proximate to the muzzle end of zone 20 which is, for illustrative purposes, one turn in ten inches. Accordingly, the rifling defined in the barrel in zone 22 does not represent an increase in the gain twist from zone 20, but is a fixed or uniform twist corresponding to that at the forward end of zone 20. The fixed twist in zone 22 results in no increased rotational velocity of the bullet as it passes between zones 20 and 22, and thus the rotational velocity of the bullet remains substantially constant from the time the bullet enters zone 20 until it passes through zone 22. The forwardmost end of zone 22 defines the opening in the muzzle end 6 of the barrel. Therefore, when the bullet completes its passage through zone 22, it is discharged through the muzzle end of the barrel at a constant rotational velocity as a result of the stabilization of the fixed or constant twist of rifling defined in the forwardmost zones 20 and 22 of the barrel 2.

In accordance with the design of the barrel discussed with respect to FIG. 1A, a gain twist is defined through a predetermined length of the barrel from the breech end 4 to a predetermined position in the barrel behind the muzzle end 6. As the bullet travels from the breech end towards this predetermined position, the rotational velocity thereof progressively increases as a result of the progressive increase in gain twist of the rifling defined in this first portion of the barrel. However, once the bullet reaches the predetermined location in the barrel, the gain twist is stabilized from this predetermined position to the muzzle end of the barrel so that the bullet passing through this second (forward) portion of the barrel travels at a constant rotational velocity and is discharged from the muzzle end of the barrel at a constant rotational velocity. In the preferred embodiment of the invention, the first portion of the barrel defining the increased gain twist is substantially in the range of between 1%–99% of the entire barrel length, so that the fixed or constant twist forward portion of the barrel is substantially in the range of 99%–1% of the entire length of the barrel. Preferably, the stabilized fixed twist forward portion of the barrel should be defined on a length of the inner surface 12 of the barrel which is about 10% of the entire barrel length so that a barrel having a typical length of between 20"–42" will have a fixed twist forward section of between 2"–4". By accelerating the rotational speed of the bullet as it initially travels through a first portion of the bore 8 from the breech end to a predetermined location behind the muzzle end, and by thereafter maintaining the rotational speed of the bullet at a constant rate through a second portion of the barrel until the bullet is discharged from the muzzle end thereof, stability of flight of the discharged bullet is enhanced by eliminating the rotational acceleration thereof so that the base of the bullet is not being rotationally accelerated at the time the bullet is discharged from the muzzle thereby increasing the accuracy of the discharged bullet. The gain twist section of the barrel increases the bullet's linear speed compared to a barrel having known rifling. Additionally, rifling defined in the barrel as illustrated by FIG. 1A tends to reduce peak pressure within the barrel at ignition of the firearm, thereby reducing the stress applied to the barrel and reducing the tendency of a bullet to strip the rifling 14 defined in the inner surface 12 of the barrel 2 as a result of excessive rotational acceleration in the barrel during discharge of the firearm.

Figure 1B:
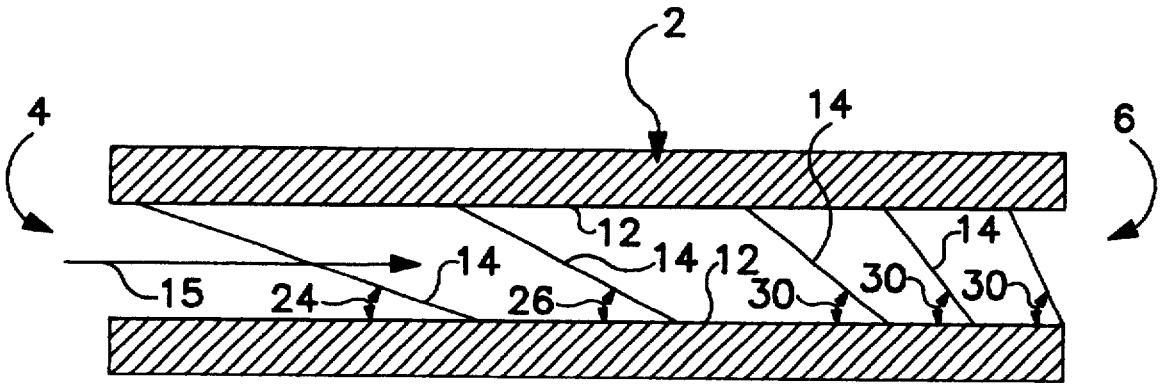
FIG. 1B is a schematic view of rifling defined in the bore of a barrel of a firearm, in accordance with a further aspect of the present invention.

Referring now to FIG. 1B, this drawing is similar to FIG.1A and schematically illustrates, in section, the first portion of the barrel 2 defining the gain twist of a firearm illustrated in FIG. 1A. Corresponding elements in FIGS. 1A and 1B have been designated by the same reference numerals. FIG. 1B illustrates that the angle of the rifling 14 relative to the inner surface 12 of the barrel 2 varies corresponding to the gain twist of rifling shown in FIG. 1A. As illustrated by FIG. 1B, the angle of the rifling 14 relative to the inner surface 12 progressively increases in the direction of travel of the bullet 15 from the breech end 4 towards the muzzle end 6 of the barrel 2. Reference numeral 24 illustrates the angular orientation of the rifling 14 closest to the breech end 4. As the bullet travels through the barrel towards the muzzle end 6 thereof, the rifling 14 in the next adjacent section of the barrel is defined at an angle designated by reference numeral 26 relative to the inner surface 12 of the barrel. Angle 26 is greater than the angle 24. As the bullet further advances through the barrel towards the muzzle end 6, the rifling 14 in the next adjacent section of the barrel is defined at an angle 28 relative to the inner surface 12 of the barrel. Angle 28 is greater than the angle 26 which is greater than angle 24. Finally, for illustrative purposes, the rifling 14 in the forwardmost gain twist section 20 of the barrel closest to the fixed twist section 22 (See FIG. 1A) and the muzzle end 6 thereof is oriented at an angle 30 relative to the inner surface 12 of the barrel. Angle 30 is greater than angle 28, which is greater than angles 26 and 24.

The rifling 14 oriented at angle 30 relative to the inner surface of the barrel is defined in zone 20 of the barrel, as illustrated by FIG. 1A. As discussed, once the bullet passes through zone 20 of the barrel, the progressive increase in gain twist of the rifling 14 ceases and a fixed or constant twist of rifling is defined between the forward end of zone 20 and the muzzle end 6 of the barrel. (See zone 22, illustrated in FIG. 1A). The rifling 14 defined in the inner surface of the barrel will remain fixed at a constant angular orientation throughout the entire forward portion of the barrel defining the fixed or uniform twist.

As is apparent from FIG. 1B, the angular orientation of the rifling 14 relative to the inner surface 12 of the barrel 2 varies in accordance with the gain twist of the rifling defined in the inner surface 12 of the barrel. As the gain twist of the rifling increases (as for example, between zones 16, 18 and 20 illustrated by FIG. 1A of the drawing), the angular orientation of the rifling relative to the inner surface of the barrel correspondingly increases (as represented by angles 24, 26 and 28 in FIG. 1B). However, the angular orientation of the rifling relative to the inner surface of the barrel remains constant when the rifling defined on the barrel is of a fixed twist, as illustrated by the forwardmost zone 22 in FIG. 1A. Accordingly, in sections of the barrel in which the gain twist of the rifling is increased to correspondingly increase the rotational speed of the bullet passing through these sections of the barrel, the angular orientation of the rifling relative to the inner surface of the barrel is variable and corresponds to variations in the gain twist, e.g.—the angular orientation of the rifling correspondingly progressively increases with the progressively increasing gain twist of the rifling in a direction from the breech end through the muzzle end of the barrel. The angular orientation of the rifling relative to the inner surface of the barrel remains constant in sections of the barrel in which the rifling is defined at a fixed twist so that a bullet passing through these sections of the barrel travels at a substantially constant rotational speed. In the preferred embodiment of the invention, the fixed twist rifling portion of the barrel is defined at the forward end thereof proximate to the muzzle end, and thus the angular orientation of the rifling relative to the inner surface of the barrel will also be constant at the forward portion of the barrel proximate to the muzzle end thereof.

In a further aspect of the present invention, the barrel 2, as illustrated by FIGS. 1A and 1B, can be designed such that the diameter of the muzzle opening 6 is different from the diameter of the breech opening 4. In the preferred embodiment of the invention, the bore 8 defined in the barrel 2 is inwardly tapered in a direction from the breech end towards the muzzle end so that the muzzle opening 6 is smaller in diameter than the breech opening 4. A bore fabricated with different sized openings at the breech and muzzle ends thereof improves the accuracy of a bullet discharged from the muzzle of the barrel, and advantageously reduces the peak pressure in the barrel during discharge of the firearm to enhance the useful life of the barrel. Preferably, the muzzle and breech openings can be selectively varied in diameter between 0.0005–0.002 inches.

Figure 2A:
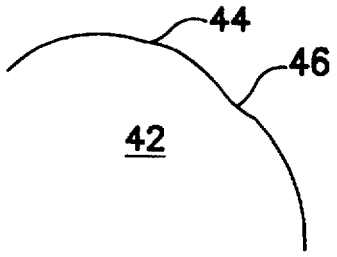
FIG. 2A schematically illustrates, in cross section, a first embodiment of a button for forming rifling in the bore of a barrel of a firearm in accordance with the present invention.
Figure 2E:
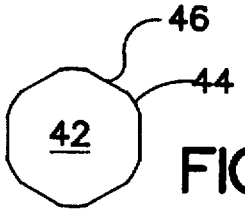
FIG. 2E schematically illustrates, in cross section, a fourth embodiment of a button for forming rifling in the bore of a barrel of a firearm in accordance with the present invention.
Figure 2B:
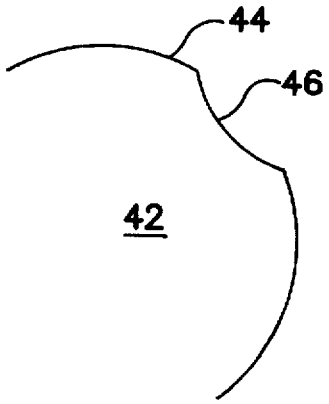
FIG. 2B schematically illustrates, in cross section, a second embodiment of a button for forming rifling in the bore of a barrel of a firearm in accordance with the present invention.
Figure 2C:
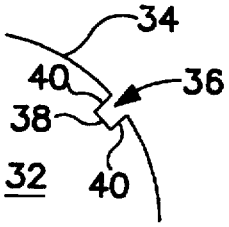
FIG. 2C (PRIOR ART)
FIG. 2C illustrates, in cross section, a known button for forming rifling in the bore of a barrel of a firearm.

Turning now to FIGS. 2A–2F of the drawing, a farther aspect of the present invention is illustrated. As is known to those skilled in the art, one method of fabricating rifling in the bore of a barrel is accomplished by pulling and twisting a button having a predetermined configuration through the barrel by a rod. FIG. 2C illustrates a typical button configuration known to the art for fabricating the rifling in the barrel of a firearm using the known button method. The button, which is designated generally be reference numeral 32, defines an arcutate outer surface 34 which is substantially circular. A vertical groove 36 is defined in the periphery 34 of the button 32. The groove 36 has an end wall 38 and two opposed sidewalls 40 which are parallel to each other and which are perpendicular to the end wall 38. The button illustrated by FIG. 2C has been conventionally used for fabricating rifling in the bore of a barrel with a fixed or constant twist. However, as a result of the vertical groove 36, the button illustrated by FIG. 2C cannot be used for fabricating rifling having a variable gain twist because twisting and pulling a button of the conventional configuration through the barrel of a rifle at a variable rotational speed causes damage to the inner surface of the barrel. Accordingly, the button method of fabricating rifling in the barrel of a firearm is employed only for a barrel having fixed or constant twist rifling, and not for variable gain twist rifling. More expensive and time consuming methods must be employed for fabricating a barrel having a variable gain twist, including custom or hand manufacture of the barrel by use of a cutter or scraper.

Figure 2D:
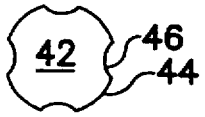
FIG. 2D schematically illustrates, in cross section, a third embodiment of a button for forming rifling in the bore of a barrel of a firearm in accordance with the present invention.
Figure 2F:
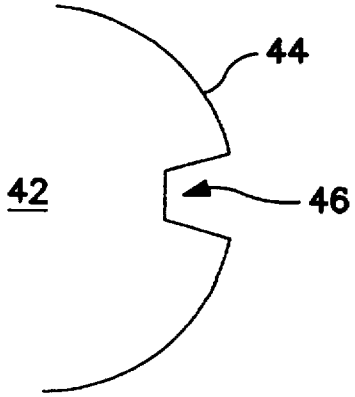
FIG. 2F schematically illustrates, in cross section, a fifth embodiment of a button for forming rifling in the bore of a barrel of a firearm in accordance with the present invention.

FIGS. 2A, 2B, 2D, 2E and 2F illustrate button designs in accordance with the present invention for use in fabrication of a variable gain twist for rifling in a barrel by relatively twisting a button at selectively variable rotational speeds as it is pulled by a rod through the barrel during the manufacture process. Buttons 42 are generally arcuate or circular in configuration and include outer peripheries designated by reference numeral 44. At least one curved or arcuate groove 46 is defined on the outer periphery of each of the buttons 42. In the preferred embodiment of the invention, the configuration of the groove 46 is generally sinusoidal in nature, or as illustrated by FIG. 2E, having flat cut-out sections in the periphery. In any event, the grooves 46 do not include any sharp or vertical edge components. Preferably, the grooves in the button will not have parallel sidewalls, and opposed sidewalls are oriented relative to each other at an angle of 50° or greater as illustrated by FIG. 2F. Buttons designed without any vertical components may be employed to fabricate variable gain twist rifling by moving the button relative to the barrel of a firearm and simultaneously twisting or rotating the button at predetermined, selectively variable rotational speeds relative to the stationary barrel to form predetermined gain twists in preselected sections of the barrel of the firearm during the fabrication process. (In the alternative, the barrel may be rotated relative to the button, or both the barrel and button may be simultaneously rotated relative to each other). The configuration of the button permits it to be relatively rotated at variable rates of speed as it is advanced through different sections of the barrel without damaging the inner surface of the barrel. Accordingly, buttons designed in the configurations illustrated by FIGS. 2A, 2B, 2D and 2E can be employed to fabricate variable gain twist rifling in the barrel of a firearm at less expense and in significantly less time than methods employed in the past.

Figure 3A:
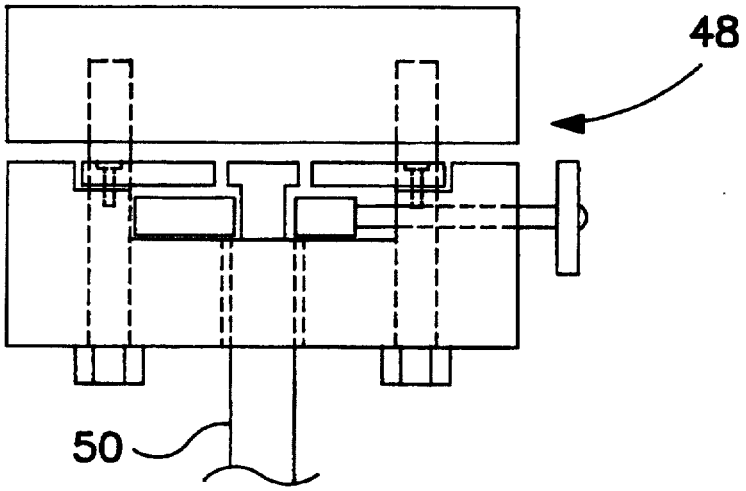
FIG. 3A illustrates a top plan view, partially in section, of a component of an apparatus for gripping a pull rod for fabricating rifling in accordance with the invention.
Figure 3B:
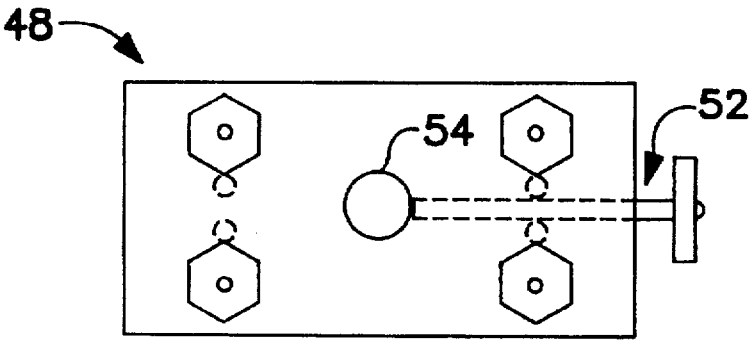
FIG. 3B illustrates a front elevational view, partially in section, of a component of an apparatus for gripping a pull rod for fabricating rifling in accordance with the invention.
Figure 3C:
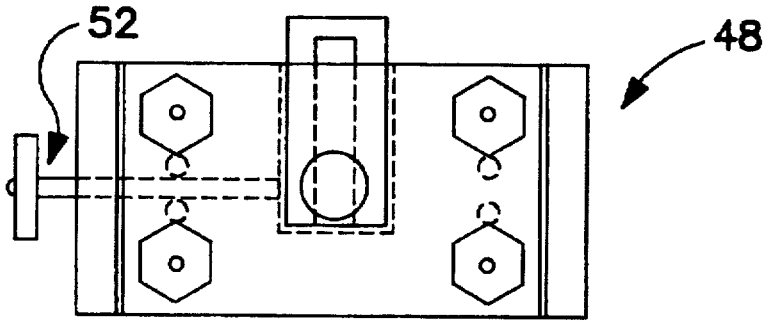
FIG. 3C illustrates a rear elevational view, partially in section, of a component of an apparatus for gripping a pull rod for fabricating rifling in accordance with the invention.

FIGS. 3A–C illustrate, respectively, a top, a front, and a rear view of an exemplary embodiment of a rod holder employed to fabricate rifling with a variable gain twist by providing relative rotation between the barrel and a button configured as illustrated by FIGS. 2A, 2B, or 2D of the drawing as the button and barrel are relatively moved in a linear direction, in accordance with the present invention. The apparatus is generally designated by reference numeral 48 and includes a movable rod 50 having a button 42 (FIGS. 2A, 2B and 2D) attached to the forward end of the rod. The rod 50 is held in a predetermined position within the apparatus 48 be securing means, as for example, a threaded handle or adjustable hydraulic cylinder, generally designated by reference numeral 52. The rod 50 carrying the button is movable relative to the apparatus 48 (and thus also movable relative to the firearm barrel) through an opening 54 defined in the front surface of the apparatus. The rod is advanced linearly relative to the barrel during fabrication thereof, and the rod (and button) is simultaneously relatively rotated at a predetermined rotational speed as it is moved linearly relative to the barrel. As discussed herein, the relative rotational speed of the rod is selectively adjusted, as desired, to result in rifling having different, preselected gain twists along different sections of the barrel. By selectively adjusting the rotational speed of the barrel and button as they are moved linearly relative to each other, the gain twist defined in the rifling at different predetermined sections of the barrel is selectively varied. Moreover, fixed twist rifling can be defined at preselected sections of the barrel by providing relative rotation of the barrel and the button at a constant rate of speed as the rod is relatively moved through a section of the barrel at which a fixed twist is desired. Accordingly, by adjusting the relative rotational speed of the rod as it is advanced linearly relative to the barrel, the operator selectively determines and varies the gain twist rifling defined at different preselected sections along the barrel as it is being fabricated, or in the alternative, selectively defines fixed twist rifling along preselected sections of the barrel.

Figure 4B:
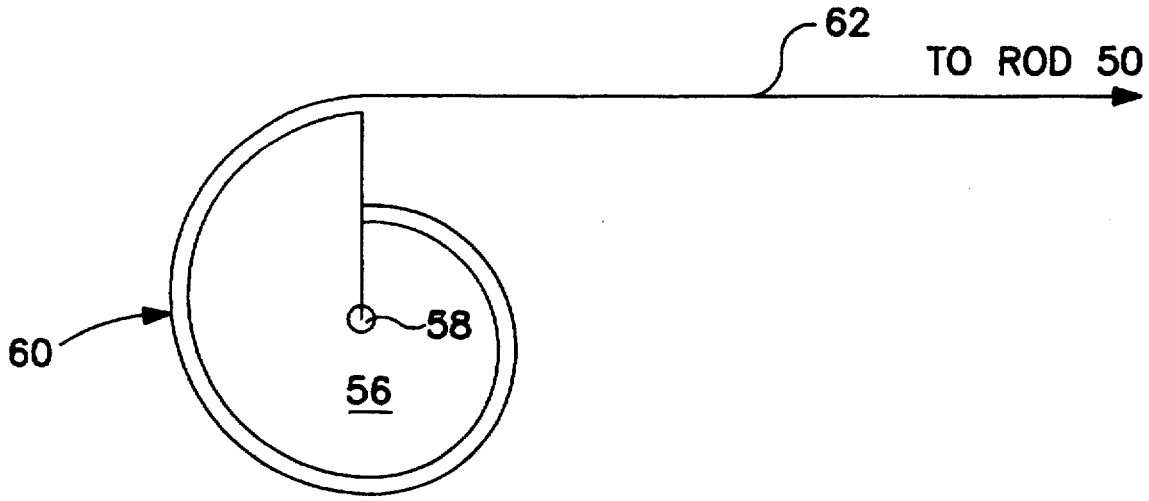
Figure 4A:
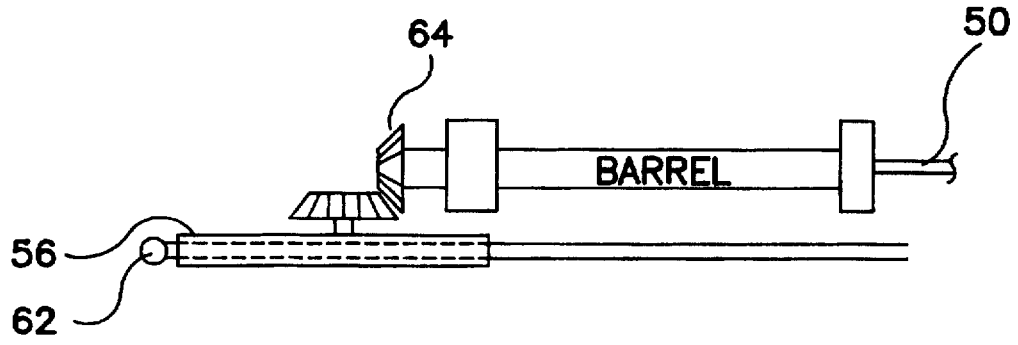
FIG. 4A schematically illustrates a portion of an apparatus for fabricating a barrel having rifling in accordance with the present invention.

FIGS. 4A and 4B illustrate exemplary means for controlling the rotational velocity or twist of the button as it is pulled through the barrel in an apparatus of the type illustrated by FIGS. 3A–3C. A cam 56 is rotatable about an axis 58. The outer surface 60 of the cam receives a cable or chain 62 wrapped therearound. The free end of the cable 62 is coupled to the rod 50 (carrying the button for fabricating the rifling in the barrel of the firearm) mounted to the apparatus 48 illustrated by FIGS. 3A, 3B and 3C. Bevel gears 64 are driven by pulling a chain 62 over a helix cam 56 to provide the barrel with a variable rate of twist. The chain 62 is attached to the rod holder illustrated in FIG. 3. The barrel is rotated as the button is pulled therethrough in a linear direction. The gear ratios of the bevel gears 64 can be varied to change the rate of twist.

Figure 5:
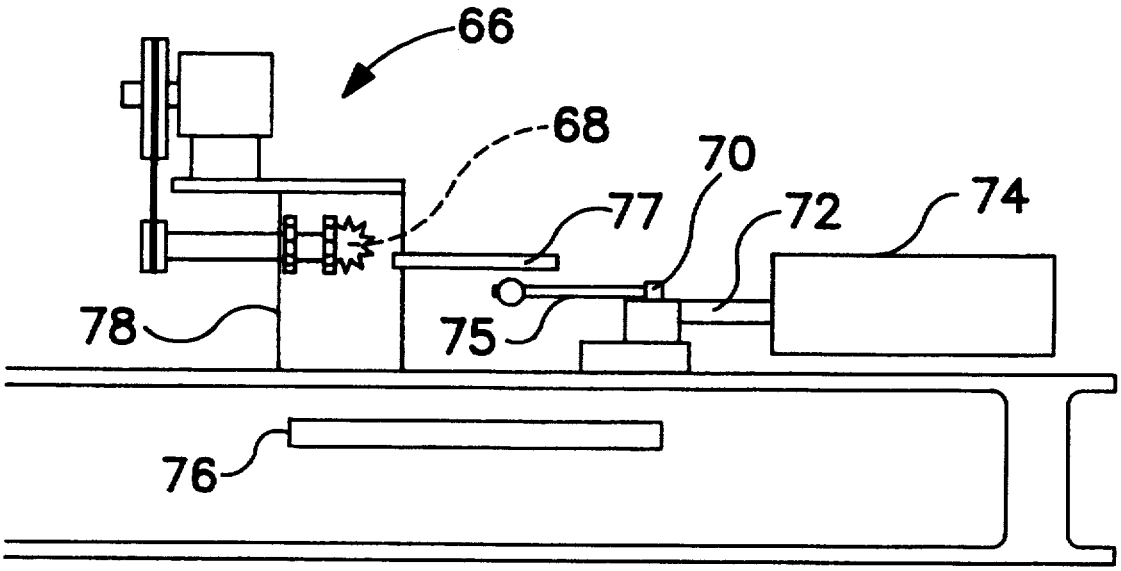
FIG. 5 schematically illustrates an apparatus operated by a computer for fabricating a barrel having rifling in accordance with the present invention.

FIG. 5 schematically illustrates another apparatus which can be employed for fabricating a barrel having a variable gain twist/uniform twist in accordance with the present invention. A stepper motor generally designated by reference numeral 66 includes bevel gears 68. A button carriage 70 is coupled to a piston 72 which enters a hydraulic cylinder 74. The button carriage 70 holds a rod 75 which has a button attached to a forward end thereof, and as previously discussed herein, the barrel and the rod are selectively movable relative to each other, both linearly and rotationally. The rate at which the rod 75 (and thus the button attached thereto) is relatively moved in a longitudinal direction relative to the hydraulic cylinder 74 is controlled by the operator. Moreover, the relative rotational speed between the rod and the barrel, and thus the relative rotational speed of the button fixedly mounted to the forward end of the rod, is controllable and selectively adjustable by the operator to define and vary the gain twist of the rifling along different preselected sections of the barrel, or in the alternative, to selectively define a uniform or constant twist of rifling at preselected sections of the barrel.

Still referring to FIG. 5, reference numeral 76 schematically illustrates sensor means for locating the position of the rod 75 carrying the button as it is moved linearly relative to the hydraulic cylinder, and thus linearly relative to the barrel 77 held and rotated by the stepper motor apparatus 78. In the preferred embodiment of the invention, the barrel is rotated relative to the button, although other relative movements of the barrel and the button are within the scope of the present invention. It is within the scope of the present invention to provide suitable computer/software control means for programming the rate at which the piston 72 is linearly advanced into the cylinder, and the rate at which the barrel is rotated relative to the rod 75 (and thus relative to the button fixedly attached to the forward end thereof) as the barrel is rotated relative to the rod and button. In this manner, the gain twist and the uniform twist of rifling to be defined at different sections of the barrel can be selected and programmed in advance of the fabrication process by controlling and varying the relative rotational speed of the barrel and the button at different positions along the barrel.

In accordance with the present invention, methods and apparatus are provided for fabricating barrels for firearms, which, at the selection of the operator, define rifling having variable progressively increasing gain twists along different preselected sections of the barrel (in a direction from the breech end towards the muzzle end), and also define uniform or constant twists at preselected sections of the barrel (preferably at the muzzle and thereof). In further aspects of the invention, the relative diameters of the breech and muzzle openings of the barrel may be varied. The variable gain twist of the rifling, combined with the uniform twist of the rifling, and/or the variations in the diameters of the breech and muzzle openings in the barrel, results in numerous advantages including increased linear velocity of a bullet discharged from the muzzle end of the barrel, enhanced stability of a bullet discharged from the muzzle end of the barrel resulting in greater accuracy of the bullet, enhanced stability of the bullet discharged from the muzzle end of the barrel as a result of reduction of barrel vibration, and decreased peak barrel pressure during discharge of the firearm thereby enhancing the useful life of the rifling and the barrel. In yet further aspects of the present invention, a button design is provided for fabrication of rifling having a variable gain twist by advancing and twisting the button relative to the barrel during fabrication thereof, thereby eliminating use of the prior art methods of fabricating rifling having a variable gain twist which require expensive and time consuming hand fabrication procedures. In still further aspects of the present invention, apparatus are provided for controlling the rate that the button is linearly advanced and rotated relative to the barrel during the fabrication process to selectively define rifling at variable gain twists and/or uniform twists at different, preselected sections of the barrel. Computer means may be programmed to control the gain twist, vary the gain twist, and provide a uniform constant twist of rifling at different, preselected sections of the barrel in advance of the fabrication process.

It is further within the scope of the present invention to fabricate gain twists in barrels of firearms by employing methods in addition to the button method discussed herein. As a first alternative, an electrical discharge machine can be used to define a predetermined gain twist along a preselected section of the barrel by removal of metal from the inner surface of the barrel by electrolysis. Appropriate guides are provided to assure that the metal remaining on the inner surface of the barrel, after the electrolysis procedure, defines the desired predetermined gain twist. As a second alternative to the button method, a gain twist can be defined in the barrel by acid etching in which metal is chemically removed from the inner surface of the barrel. Appropriate guides are provided to assure that the metal remaining on the inner surface of the barrel, after the acid etching procedure, defines the desired predetermined gain twist. Both of these alternative fabrication methods can be used to produce barrels for firearms defining gain twists in a manner which, like the button method, eliminates the time and expense of cutting or scraping to produce a gain twist. Similarly, a gain twist can be fabricated by hammer forging a barrel over a mandrel. Although this method is generally known to the art, it has not, to Applicant's knowledge., been applied to fabricate a variable gain twist for a barrel of a firearm.

Other features and advantages falling within the scope of the invention disclosed herein will become apparent to those skilled in the art. For example, it is within the scope of the present invention to produce barrels having only a gain twist, and to produce barrels having both a gain twist and a contant twist. Accordingly, the description of the preferred embodiments of the invention discussed herein are intended to be illustrative only, and not restrictive of the scope of the invention, that scope being defined by the following claims and all equivalents thereto.

We claim:

1. A method for fabricating a variable gain twist in a barrel of a firearm, said method including the steps of:

providing relative linear movement between a button shaped element and a barrel section of a firearm, providing relative rotation between said button shaped element and said barrel at a predetermined rotational speed, and selectively varying the relative rotational speed as said button shaped element and said barrel are linearly moved relative to each other for defining a variable gain twist rifling at preselected sections along said barrel.

2. The method as claimed in claim 1 wherein said step of providing relative rotation between said button shaped element and said barrel at a predetermined rotational speed includes the step of rotating a button shaped element having a periphery which is generally sinusoidal in configuration.

3. The method as claimed in claim 1 wherein the step of providing relative rotation between said button shaped element and said barrel at a predetermined rotational speed includes the step of rotating a button shaped element defining at least one flat section on a periphery thereof.

4. The method as claimed in claim 1 wherein the step of providing relative rotation between said button shaped element and said barrel at a predetermined rotational speed includes the step of rotating a button shaped element defining at least one groove in a periphery thereof, said groove having opposed sidewalls which are not parallel.

5. The method as claimed in claim 4 wherein the stem of rotating said button shaped element includes rotating a button shaped element defining at least one groove in a periphery thereof, said groove having opposed sidewalls which are oriented at a relative angle of at least 50°.

6. The method as claimed in claim 1 further including the step of providing means for selectively controlling said relative rotational speed of said button shaped element and said barrel as said button shaped element and said barrel are moved linearly relative to each other, said means including a computer for controlling said relative rotational speed at different linear positions of said button shaped element relative to said barrel.

7. The method as claimed in claim 4 wherein the step of rotating said button shaped element includes the step of rotating a button shaped element defining at least one groove in a periphery thereof, said groove having opposed sidewalls oriented at a relative angle of at least 25°.

8. The method as claimed in claim 4 wherein the step of rotating said button shaped element includes the step of rotating a button shaped element defining at least one groove in a periphery thereof, said groove having opposed sidewalls oriented at a relative angle of at least 30°.

9. The method as claimed in claim 4 wherein the step of rotating said button shaped element includes the step of rotating a button shaped element defining at least one groove in a periphery thereof, said groove having opposed sidewalls oriented at a relative angle in a range of between 25°–30°.

10. An apparatus for fabricating a barrel of a firearm, said apparatus including:

means for providing relative rotation between a barrel and an element for defining rifling in said barrel, means for providing relative linear movement between said barrel and said element, means for controlling the speed of said relative rotation between said barrel and said element, means for controlling said relative linear movement between said barrel and said element, wherein selective control of said speed of said relative rotation and said relative linear movement results in gain twist and uniform twist at preselected sections of said barrel, and wherein said element is a button defining a periphery having at least one cut-out portion having no parallel sidewalls.

11. The apparatus as claimed in claim 10 wherein said means for controlling said relative rotation and said relative linear movement include a programmable computer.

* * * * *

UNITED STATES PATENT AND TRADEMARK OFFICE

CERTIFICATE OF CORRECTION

PATENT NO. : 5,894,770

DATED : April 20, 1999

INVENTOR(S) : Henry A. Rudkin, Jr. and Donald Barker

It is certified that error appears in the above-identified patent and that said Letters Patent is hereby corrected as shown below:

Claim 5, Line 1 (Column 11, Line 20):

Delete "stem" and substitute - -step- -.

Signed and Sealed this

Third Day of August, 1999

*Attest:*

*Attesting Officer*

Q. TODD DICKINSON

*Acting Commissioner of Patents and Trademarks*